US007170368B2

(12) United States Patent
Eng

(10) Patent No.: US 7,170,368 B2
(45) Date of Patent: Jan. 30, 2007

(54) PHASE MATCHING USING A HIGH THERMAL EXPANSION WAVEGUIDE

(75) Inventor: John E. Eng, Buena Park, CA (US)

(73) Assignee: The Boeing Company, Chicago, IL (US)

( * ) Notice: Subject to any disclaimer, the term of this patent is extended or adjusted under 35 U.S.C. 154(b) by 95 days.

(21) Appl. No.: 10/983,282

(22) Filed: Nov. 5, 2004

(65) Prior Publication Data

US 2006/0097822 A1 May 11, 2006

(51) Int. Cl.
*H01P 5/12* (2006.01)

(52) U.S. Cl. ..... 333/125; 333/248

(58) Field of Classification Search ..... 333/234, 333/229, 125

See application file for complete search history.

(56) References Cited

U.S. PATENT DOCUMENTS 3,924,927 A * 12/1975 Wolf ..... 385/142
5,380,386 A * 1/1995 Oldham et al. ..... 156/150
6,018,390 A * 1/2000 Youmans et al. ..... 356/477
6,077,928 A * 6/2000 Suh et al. ..... 528/170
6,107,901 A * 8/2000 Crouch et al. ..... 333/239
6,603,559 B1 * 8/2003 Tsao et al. ..... 356/479
6,643,046 B1 * 11/2003 Ibe et al. ..... 359/238
6,643,431 B1 * 11/2003 Hatayama et al. ..... 385/39
7,006,716 B1 * 2/2006 Bhowmik ..... 385/3

FOREIGN PATENT DOCUMENTS

JP 62253792 * 11/1987
JP 07058527 * 3/1995

* cited by examiner

*Primary Examiner*—Robert Pascal
*Assistant Examiner*—Kimberly E Glenn
(74) *Attorney, Agent, or Firm*—Canady & Lortz LLP; Bradley K. Lortz

(57) ABSTRACT

An apparatuses and methods for phase matching power combined signals are described. A typical apparatus includes at least a waveguide portion in at least a first branch conducting a first electromagnetic signal of a combiner, the waveguide portion having an effective size and a thermal control system effecting a temperature change in the waveguide portion to alter the effective size. Altering the effective size of the waveguide portion adjusts phase matching between the first electromagnetic signal of the first branch and at least a second electromagnetic signal of a second branch of the combiner. High thermal expansion coefficient materials including silver plated polyetherimide can be used. In addition, composite materials having anisotropic thermal expansion may be used.

25 Claims, 8 Drawing Sheets

PHASE MATCHING USING A HIGH THERMAL EXPANSION WAVEGUIDE

BACKGROUND OF THE INVENTION

1. Field of the Invention

The present invention relates to systems and methods for power combining high frequency electromagnetic signals. Particularly, this invention relates to efficient power combining of high power radio frequency (RF) signals in satellite applications.

2. Description of the Related Art

In many high power wireless communications systems, amplified signals are often combined in parallel to produce the high power output signals. For example, a satellite-based communication system may comprise a plurality of high power amplifiers such as traveling wave tube amplifiers (TWTAs) each amplifying the same RF signal. The respective output amplified RF signals from each TWTA are then combined in parallel to yield the high power broadcast RF signal that may be transmitted to Earth-based receivers. This technique of combining amplified signals is termed "power combining".

One significant challenge in power combining signals arises from differences in phase among the combined signals. Even slight variations in the signal phase of the signals can negatively impact the overall power efficiency of the combined signals. In addition, phase variation among the signals also distorts the resulting combined signal. Such phase variation occurs as a consequence of slight differences in the amplifiers performance characteristics and the waveguide path lengths. Phase matching the signals becomes more difficult when higher frequency signals are used because wavelengths decrease and phase variation becomes more sensitive to line length variations. Thus, as more and more communication systems are developed for higher frequencies, the problem of phase matching becomes more prevalent. Accordingly, phase matching of power combined signals is often an objective in the design and production of systems using power combining.

Aligning multiple high power amplifiers to power combine efficiently is currently performed through a labor-intensive, manual procedure involving the use of mechanical waveguide shims to vary the path length of individual amplifier output ports. Adjusting the relative path lengths alters the relative phase of the combined signals. Thus, power combining efficiency is maximized through this shimming procedure. However, the shimming procedure yields a fixed result, tuning the power combiner to a single setting. The shimming procedure does not account for changes over the life of the system. Thus, differential variation among amplifier performance and waveguide characteristics occurring due to environmental (e.g. temperature) and other changes can greatly impact the power combining efficiency. For example, a conventional satellite-based communication system may be designed for a fifteen year mission during which the system is subject to a wide variety of environmental changes. Analyzing the phase misalignment and compensating with shimming becomes very costly and difficult (if not impossible) for systems employing phase sensitive power combining.

In view of the foregoing, the present invention provides a system and method for efficient phase matching power combined RF signals. In addition, embodiments of the present invention can be integrated into a satellite communications system to provide constant automatic phase adjustment between the power combined signals. These and other advantages of the present invention are detailed hereafter.

SUMMARY OF THE INVENTION

Embodiments of the invention comprise various apparatuses and methods for phase matching power combined signals. A typical apparatus includes at least a waveguide portion in at least a first branch conducting a first electromagnetic signal of a combiner, the waveguide portion having an effective size and a thermal control system effecting a temperature change in the waveguide portion to alter the effective size. Altering the effective size of the waveguide portion adjusts phase matching between the first electromagnetic signal of the first branch and at least a second electromagnetic signal of a second branch of the combiner.

Typically, the thermally controlled waveguide portion comprises a high coefficient of thermal expansion (CTE) relative to the remaining waveguides of the system. For example, materials such as polyetherimide or zinc may be used in the thermally controlled waveguide portion. In some embodiments, the polyetherimide may be glass filled. Silver plating of the waveguide portion may be necessary to obtain the necessary electrical properties. In further embodiments, composite materials having anisotropic thermal expansion may be used.

Typically, the effective size of the waveguide portion comprises an effective length. The waveguide portion can comprise a material having anisotropic thermal expansion properties with a highest coefficient of thermal expansion along the effective length. Furthermore, the waveguide portion may comprise a coil.

In further embodiments, the thermal control system determines the temperature change in the waveguide portion based upon output of a waste port of the combiner. The thermal control system may include a heater element proximate to the waveguide portion. The temperature change is effected by selectively applying and removing power to the heater element. In some embodiments, every branch of the combiner may include a thermally controlled waveguide portion. Furthermore, the combiner may be implemented with sub-branches where at least one branch of the combiner comprises at least two sub-branches and at least one of the thermally controlled waveguide portions is in one of the sub-branches.

In one exemplary embodiment, a plurality of TWTAs may be power combined using one or more hybrid power combiners. The power combined TWTAs may be grouped in pairs, e.g. four TWTAs may be combined by power combining the outputs of two pairs of power combined TWTAs. Embodiments of the invention achieve phase matching of the amplified signals using one or more variable length waveguide portions in one or more of the power combined signal paths. In one exemplary embodiment, the effective length of a variable length waveguide portion may be controlled by altering the temperature of the waveguide portion which is constructed with a material with a high coefficient of thermal expansion. As the temperature of the waveguide portion changes, so does the size of the waveguide, particularly the length.

BRIEF DESCRIPTION OF THE DRAWINGS

Referring now to the drawings in which like reference numbers represent corresponding parts throughout.

DETAILED DESCRIPTION OF THE PREFERRED EMBODIMENT

1. Overview

As described above, embodiments of the present invention alleviate the problems associated with phase matching signals in a combiner, particularly at higher frequencies. The benefits of the invention find application in communication systems which operate using high frequency (e.g. RF) signals at high power levels, particularly satellite-based and other high power wireless communication systems. Some applications include high power spot beam applications for commercial and military communication systems. For example, satellite television services such as DIRECTV and over-the-air broadband applications can readily benefit from embodiments of the present invention. Embodiments of the invention employ thermally adjusted waveguides to tune in signal phase across combined signals. High CTE materials may be used in the thermally controlled waveguides to optimize the effect. Adjustments to the thermally controlled waveguides may be directed through feedback from a waste port sensor on the combiner.

Figure 1:
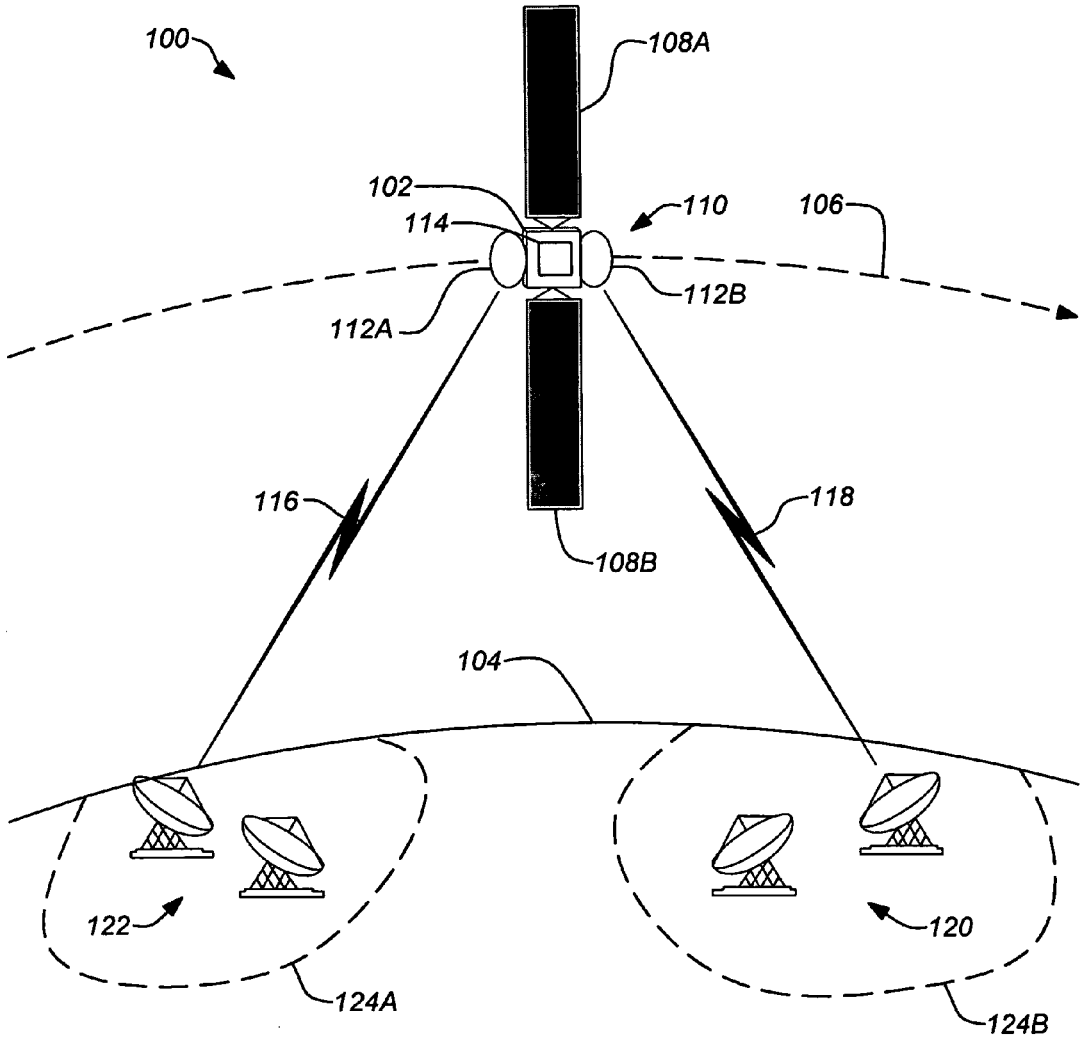
FIG. 1 illustrates a typical satellite communication system.

FIG. 1 schematically illustrates a typical satellite communication system 100 that can benefit from embodiments of the invention. A satellite 102 is disposed in an orbit of the Earth 104 along an orbital path 106 as shown. The orbital path 106 is geostationary for many communication satellites, positioning the satellite 102 over the equator in a stable orbit which precisely matches the Earth's rotation. Thus, the satellite 102 remains in a substantially fixed position relative to any point on the Earth 104. Such an orbit eliminates the need for satellite tracking from the Earth 104; all ground-based transmit and receive antenna may remain locked in a stationary pointing direction. However, as will become clear hereafter, embodiments of the present invention are not limited to any particular orbital design.

A typical satellite 102 comprises a power system which commonly includes solar panels 108A, 108B to collect solar energy and convert it to electrical energy. Batteries (not shown) may be used to store the electrical energy. An essential component of any type of communication satellite 102 is an antenna system 110. The antenna system 110 typically includes one or more reflectors 112A, 112B for reflecting and focusing electromagnetic signals transmitted to and received from the Earth 104 and/or possibly other satellites. The satellite 102 also includes some type of amplifier system 114 for amplifying a received signal 116 with enough power so that the transmitted signal 118 is capable of being received by ground-based antenna 120.

In the typical communication system 100, one or more ground-based transmitters 122 transmit signals 118 to the receive reflector 112A of the antenna system 110. The communication system 100 is designed such that the receive reflector 112A operates over a specified coverage area 124A. Ground-based transmitters 122 must be located within the coverage area 124A in order for their transmitted signals 116 (i.e. uplink signals) to be properly received by the satellite 102. Similarly, the transmit reflector 112B of the antenna system 110 operates over a specified coverage area 124B where ground-based receivers 120 must be located in order to properly receive the transmitted signal 118 (i.e. downlink signal) from the transmit reflector 112B of the antenna system 110. Coverage areas 124A, 124B may encompass distinct regions or they may intersect depending upon the application and the implementation technique as discussed hereafter. For example, a very common coverage region for communication systems is the region defined by the continental U.S. (CONUS), not including Alaska and Hawaii.

Many different configurations are possible for the coverage areas 124A, 124B, depending upon the overall purpose and design of the satellite-based communication system 100. Spatial and frequency and time diversity are three specific communication system design principles that should be mentioned. They relate to coverage configurations and signal carrier frequencies being used in a communication system. As is well known, signals having substantially similar carrier frequencies (and/or polarization) will interfere, often preventing coherent reception of either signal. Understanding this, the principle of "frequency diversity" is readily clear; use carrier signals having different frequencies (and/or polarizations) to avoid interference. The principle of "spatial diversity" proceeds from an understanding that in order for signals to interfere they must exist in the same space. Thus, spatial diversity requires that in order to avoid interference, separate signals having substantially similar carrier frequencies should not be transmitted through the same space. In the example of FIG. 1, the coverage areas 124A, 124B provide spatial diversity because they do not intersect. Accordingly, the signals 116, 118 may employ a common carrier frequency. If coverage areas 124A, 124B were required to intersect, frequency diversity may be necessary to avoid signal interference. Finally, the principle of "time diversity" proceeds from the understanding that in order for signals to interfere they must exist in the same time. Thus, time diversity requires that in order to avoid interference, separate signals having substantially similar carrier frequencies should not be transmitted at the same time. The fundamental principles of frequency, spatial and time diversity are applied in any communication system design (particularly, satellite based systems). It should be noted that embodiments of the present invention are not limited to any particular communication system configuration, but may be used in any system employing one or more of the diversity design principles.

2. Conventional Satellite Amplifier Architecture

Figure 2:
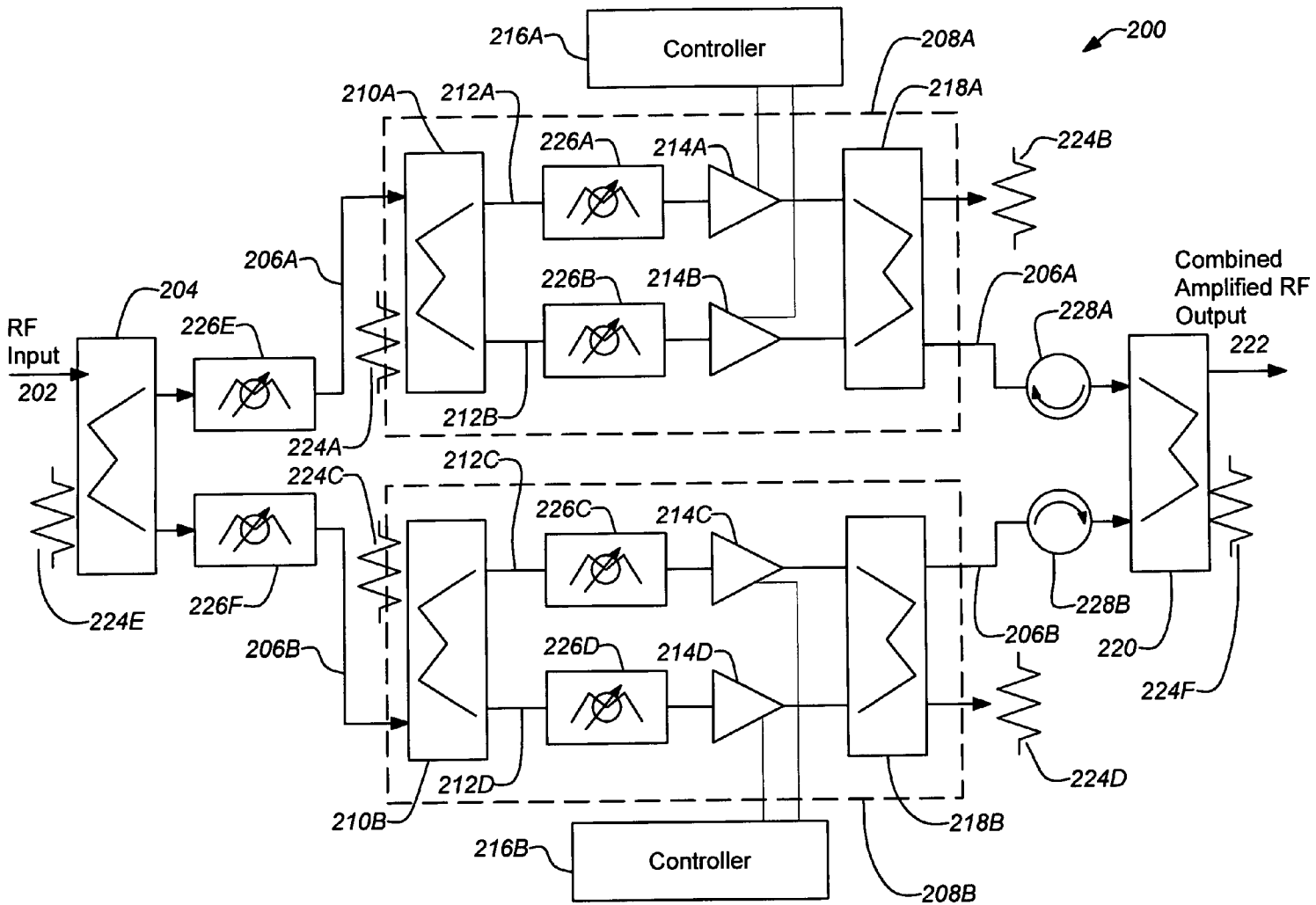
FIG. 2 illustrates conventional amplifying system employing power combined signals in a satellite application.

FIG. 2 illustrates conventional power combining system 200 in a satellite application. For example, the amplifier system 114 of the satellite system 100 of FIG. 1 may comprise the power combining system 200. A low power high frequency signal 202 is input into a signal divider 204 of the power combining system 200. The divider 204 splits the signal 202 into two substantially identical signals on two separate branches 206A, 206B of the power combiner 200. Note however, that although the branch signals begin substantially identical, differences arise, e.g. phase, as they are communicated through their separate paths which result in inefficiencies in combining the signals at the output. The separate branches 206A, 206B are each fed into separate amplifier subsystems 208A, 208B.

Within each amplifier subsystem 208A, 208B, each branch 206A, 206B is passed through a secondary divider 210A, 210B which yields substantially paired identical signals on sub-branches 212A, 212B and 212C, 212D of their respective amplifier subsystem 208A, 208B. Here also, the sub-branch signals are subject to differences (e.g. phase) at the downstream combiners 218A, 218B, 220. Each of the sub-branches 212A, 212B, 212C, 212D communicates its respective signal to amplifiers 214A, 214B, 214C, 214D (typically a traveling wave tube amplifier [TWTA]), respectively. Operation of the amplifiers 214A, 214B, 214C, 214D is managed by one or more amplifier controllers 216A, 216B. In this example, a separate amplifier controller 216A, 216B is used for the amplifiers pairs 214A, 214B and 214C, 214D of each amplifier subsystem 208A, 208B, respectively. Typically, amplifier control is based upon feedback regarding received power through telemetry and command.

After amplification, the pairs of sub-branches 212A, 212B and 212C, 212D in each amplifier subsystem 208A, 208B are power combined in combiners 218A, 218B which separately yield two high power signals at the output ends of branches 206A, 206B. The two high power signals are then combined in a final power combiner 220 to yield the power combined output signal 222. The output signal 222 has sufficient power to be transmitted in a downlink to one or more ground receivers 120 as shown in the example system 100 of FIG. 1. It is important to discuss the functions of some other elements employed in the system 200 of FIG. 2.

Each power combiner 218A, 218B, 220 and divider 204, 210A, 210B include a waste port 224A–224F as indicated by the extraneous signal symbol. The waste ports 224A–224F couple out excess electromagnetic radiation that could not be coupled through each combiner 218A, 218B, 220 or divider 204, 210A, 210B. The waste port 224A–224F output represents a system loss which may indicate significant inefficiency, particular in the case of the power combiners 218A, 218B, 220 which combine signals after amplification.

In addition, throughout the system 300 manual phase shifter/attenuators 226A–226F are employed in line with the branches 206A, 206B and/or sub-branches 212A–212D at various points as shown. The manual phase shifter/attenuators 226A–226F employed for course adjustments during production as the system is tuned on the ground. Their settings are fixed in production and they provide no adjustment as the satellite operates.

Finally, the system 200 may also employ isolators 228A, 228B which prevent mismatched signals from reflecting back into the amplifier output ports and damaging the amplifiers.

3. Phase Matching with Embodiments of the Invention

Embodiments of the present invention comprise at least a waveguide portion in at least one branch of a combiner that is thermally adjusted to modify the output phase of the electromagnetic signal that it carries. The waveguide portion has an effective length which correlates to the output phase of the carried electromagnetic signal. Thus, a temperature change in the waveguide portion alters the effective length and thereby changes the output phase. Altering the effective length of the waveguide portion in this manner can be used to adjust phase matching between branches of a combiner. A thermal control system can be used to effect the appropriate temperature change.

Figure 3A:
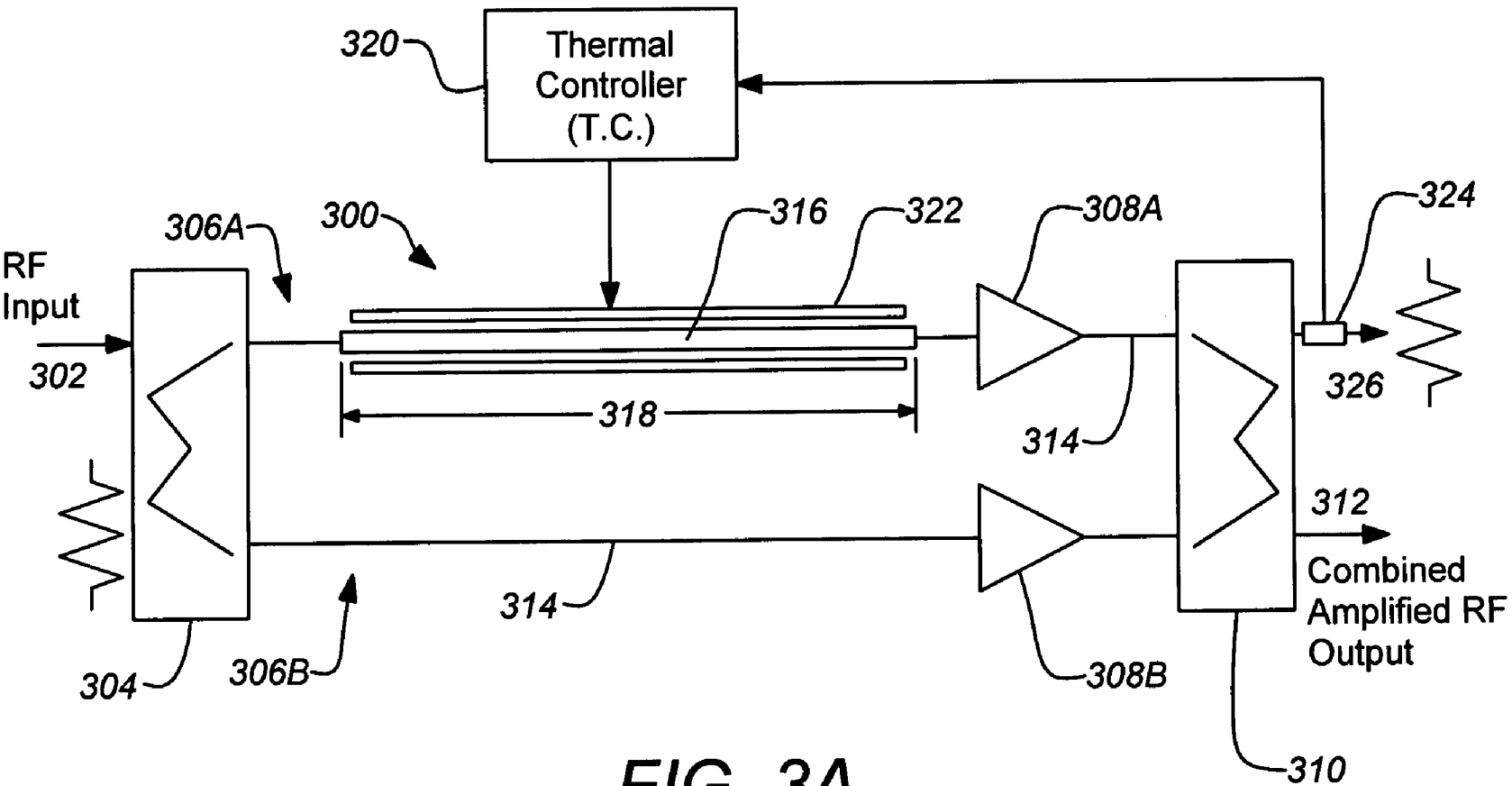
FIG. 3A is a block diagram of an exemplary embodiment of the invention.

FIG. 3A is a block diagram of an exemplary embodiment of a thermally-adjusted phase-shifting waveguide 300 of the present invention. An electromagnetic signal 302 is input into the signal divider 304 and split into two branches 306A, 306B each carrying a substantially identical signal. Note however, that although the branch signals begin substantially identical, differences arise, e.g. phase, as they are communicated through their separate paths which result in inefficiencies in combining the signals at the output. Thermal adjustment of the signal phase (described below) improves the efficiency of the power combining. Similar to the conventional power combining system 200, the signals of the two branches 306A, 306B are amplified respectively by separate amplifiers 308A, 308B and then combined in the combiner 310 to yield the combined amplified signal 312 at the output. The amplifiers can be traveling wave tube amplifiers (TWTA) or any other amplifier type used in communication systems.

Throughout the system, standard waveguides 314 are used to carry the electromagnetic signals. As known in the art, standard waveguides 314 are typically hollow aluminum alloy conduits having a geometric cross-section (e.g. rectangular, circular, elliptical, etc.). Embodiments of the invention include at least a waveguide portion 316 of at least one of the two branches 306A, 306B that is thermally adjusted to alter its size 318, particularly its length. The size 318 of the waveguide portion 316 affects the signal phase at the output in the combiner 310. This effect is more pronounced for higher frequency signals. Thus, by adjusting the size 318 of the waveguide portion 316 of the first branch 306A relative to the standard waveguide 314 of the second brand 306B, phase matching of the combined signals can be achieved. The waveguide portion 316 must be sufficiently long so that the change in length effects a significant change in the output signal phase, although other dimensional changes (e.g. width and height) result in a negligible impact on performance.

A thermal control system may be used to determine the effected temperature change in the waveguide portion 316. For example, the thermal control system can comprise a thermal controller 320 which operates a heater 322 disposed proximate to the waveguide portion 316. The controller 320 may receive input from a sensor 324 at a waste port 326 of the combiner 310 in a control loop to determine whether to increase or decrease the temperature of the waveguide portion to alter the length of the waveguide portion and obtain improved phase matching among the combined signals. For example, as more power is sensed at the waste port 326, the controller 320 effects a temperature change in the waveguide portion 316 to improve the phase matching between the combined signals and reduce the power to the waste port 326.

The controller 320 may effect the temperature change by selectively applying and removing power to the heater 322 proximate to the waveguide portion 316. Excess heat energy may be radiatively dissipated. It should be noted that the heater 322, may equivalently comprise an active cooler, such as a Peltier cooler or any other appropriate heat transfer device.

Thermal signal phase control can be improved by employing a material having a high coefficient of thermal expansion (CTE) in the waveguide portion 316. For example, materials such as polyetherimide (e.g. ULTEM 1000 with a CTE of approximately 54 ppm/° C.) or zinc (with a CTE of approximately 39.6 ppm/° C.) may be used in the thermally controlled waveguide portion 316. In some embodiments, the polyetherimide may be glass filled. Silver plating of the waveguide portion 316 may be necessary to obtain the necessary electrical properties. In other embodiments, composite materials having anisotropic thermal expansion can be used to minimize any potential deleterious effects of dimensional changes to the height and width of the waveguide portion 316. In addition, the waveguide portion 316 may be thermally isolated so that the temperature can be more easily controlled, typically at a temperature above the ambient temperature. Because polyetherimide is not a very good thermal conductor, thermally isolating it from the standard waveguides 314 can be accomplished with low thermal conductivity screws and/or mounting hardware.

Figure 3B:
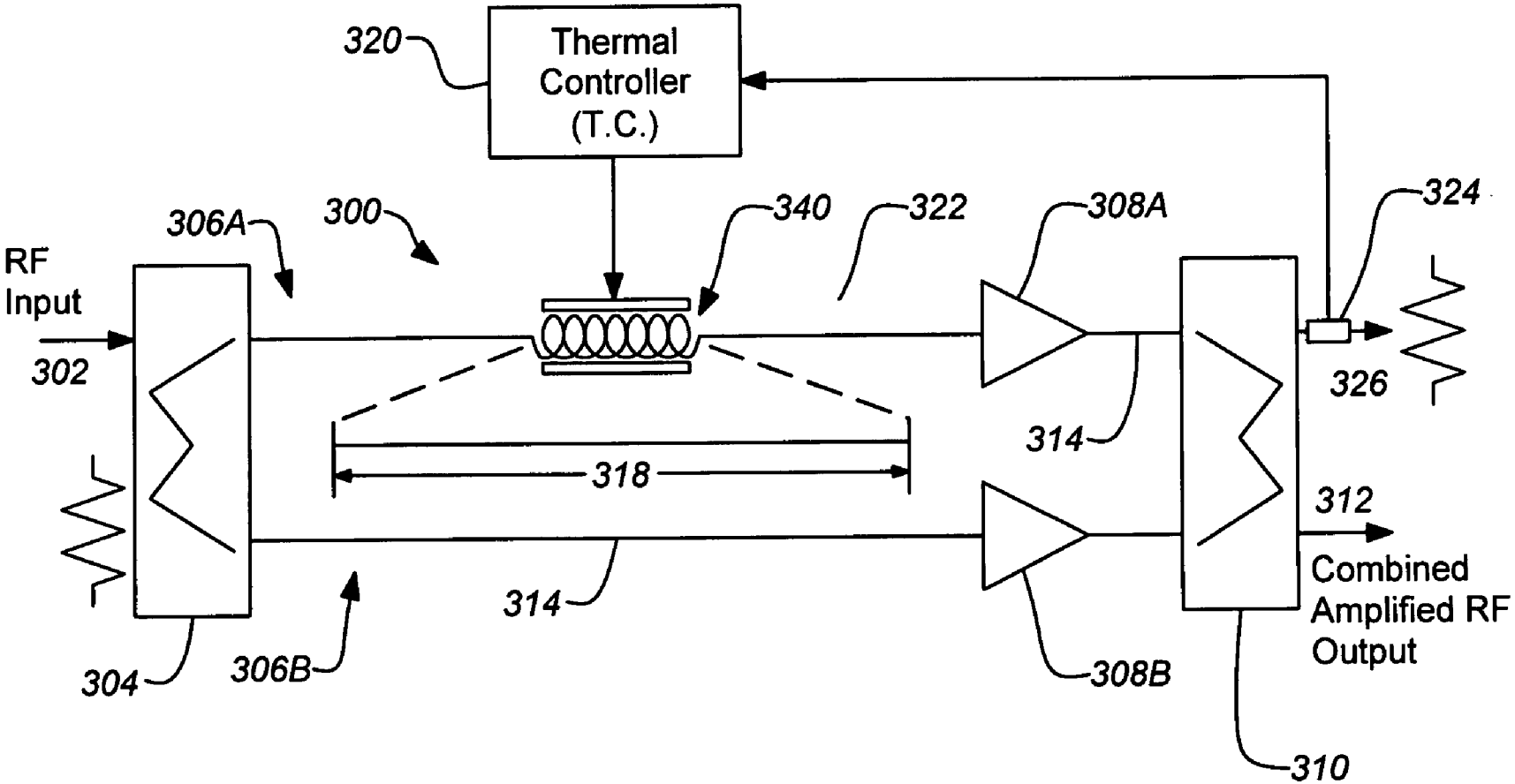
FIG. 3B illustrates a coiled waveguide portion in an exemplary embodiment of the invention.

FIG. 3B illustrates a coiled waveguide portion 340 in a thermally-adjusted phase-shifting waveguide 300. The embodiment of FIG. 3B operates in the essentially the same manner as the embodiment of FIG. 3A detailed above. However, the use of the coiled waveguide portion 340 adds certain other advantages. With a coiled waveguide portion 340 the effective size 318 corresponds to the uncoiled length of the waveguide portion 340. Using a coiled configuration accommodates the change in length without mechanically stressing mounting and interfaces to the standard waveguides 314 at either end of the coiled waveguide portion 340. In addition, the coiled waveguide portion allows for a large change in effective length in a compact package.

Those skilled in the art can readily develop designs implementing the invention based upon the specifications of the particular communication system. For example, a 20 GHz signal frequency used in a communication system corresponds to a wavelength of 15 mm. Thus, to obtain a 10 degree phase adjustment, the effective length of the waveguide portion would need to change 0.4 mm (relative to the remaining waveguides). Employing a material having a CTE of 50 ppm/° C. in a waveguide having an 80 cm effective length, the required 0.4 mm of adjustment can be achieved with a 10° C. temperature change. Trade offs can be made between the amount of temperature variation and the length of high CTE waveguide used.

In one exemplary system embodiment detailed hereafter, a plurality of TWTAs may be power combined using one or more hybrid power combiners. The power combined TWTAs may be grouped in pairs, e.g. four TWTAs may be combined by power combining the outputs of two pairs of power combined TWTAs. Embodiments of the invention can achieve phase matching of the amplified signals using one or more variable length waveguide portions in one or more braches of the power combined signal paths.

Figure 4:
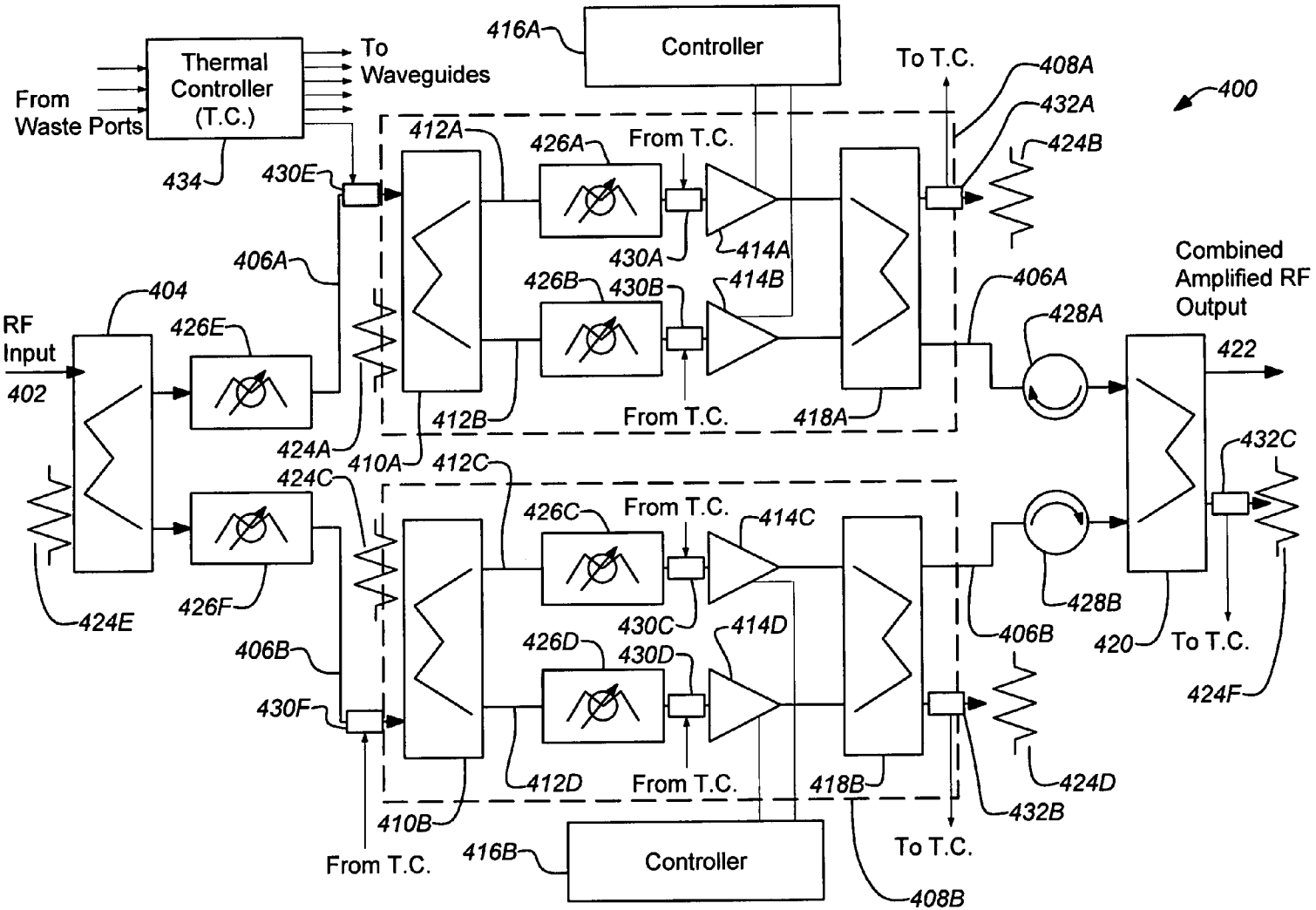
FIG. 4 illustrates an exemplary system embodiment of the invention employing control of a relative waveguide effective length through thermal modulation to produce phase matching.

FIG. 4 illustrates an exemplary system embodiment employing control of relative waveguide effective lengths through thermal modulation to produce phase matching. For example, the amplifier system 114 of the satellite system 100 of FIG. 1 may comprise the power combining system 400. A low power high frequency signal 402 is input into a signal divider 404 of the power combining system 400. The divider 404 splits the signal 402 into two substantially identical signals on two separate branches 406A, and 406B. Note however, that although the branched signals begin substantially identical, differences arise, e.g. phase, as they are communicated through their separate paths which result in inefficiencies in combining the signals at the output. The separate branches 406A, 406B are each fed into separate amplifier subsystems 408A, 408B.

Within each amplifier subsystem 408A, 408B, each branch 406A, 406B is passed through a secondary divider 410A, 410B which yields substantially paired identical signals on sub-branches 412A, 412B and 412C, 412D of their respective amplifier subsystem 408A, 408B. Here also, the sub-branch signals are subject to differences (e.g. phase) at the downstream combiners 418A, 418B, 420. Each of the sub-branches 412A, 412B, 412C, 412D communicates its respective signal to amplifiers 414A, 414B, 414C, 414D (typically a traveling wave tube amplifier [TWTA]), respectively. Operation of the amplifiers 414A, 414B, 414C, 414D is managed by one or more amplifier controllers 416A, 416B. In this example, a separate amplifier controller 416A, 416B is used for the amplifiers pairs 414A, 414B and 414C, 414D of each amplifier subsystem 408A, 408B, respectively. Typically, amplifier control is based upon feedback regarding received power through telemetry and command.

After amplification, the pairs of sub-branches 412A, 412B and 412C, 412D in each amplifier subsystem 408A, 408B are power combined in combiners 418A, 418B which separately yield two high power signals at the output ends of branches 406A, 406B. The two high power signals are then combined in a final power combiner 420 to yield the power combined output signal 422. The output signal 422 has sufficient power to be transmitted in a downlink to one or more ground receivers 120 as shown in the example system 100 of FIG. 1.

Each power combiner 418A, 418B, 420 and divider 404, 410A, 410B include a waste port 424A–424F as indicated by the extraneous signal symbol. The waste ports 424A–424F couple out excess electromagnetic radiation that could not be coupled through each combiner 418A, 418B, 420 or divider 404, 410A, 410B. The waste port 424A–424F output represents a system loss which may indicate significant inefficiency, particular in the case of the power combiners 418A, 418B, 420 which combine signals after amplification.

Similar to the embodiment in FIG. 3, thermally controlled waveguide portions 430A–430F are employed at various locations in the system 400 to provide phase matching of the combined signals. In this system 400, phase control is further expanded through the use of separate thermally controlled waveguide portions 430A, 430B and 430C, 430D on each sub-branch 412A, 412B and 412C, 412D of each amplifier subsystem 408A, 408B. In addition, each branch 406A, 406B of the power combiner system 400 also includes a thermally controlled waveguide portion 430E, 430F. Each of the thermally controlled waveguide portions 430A–430F includes a heat transfer device such as a heater that is coupled to one or more thermal controllers 434.

Similar to the embodiment of FIG. 3, the thermal controller 434 receives input from sensors 432A, 432B, 432C on the waste ports 424B, 424D, 424C on the combiners 418A, 418B, 420, respectively. The thermal controller 434 interprets the sensor input and determines the appropriate temperature changes to apply to the separate waveguide portions 430A–430F in order to improve phase matching of the combined signals carried by the branches 406A, 406B and sub-branches 412A–412D of the power combiner system 400.

It should be noted that throughout the system 400 manual phase shifter/attenuators 426A–426F are employed in line with the branches 406A, 406B and/or sub-branches 414A–414D at various points as shown. The manual phase shifter/attenuators 426A–426F employed for course adjustments during production as the system is tuned on the ground. Their settings are fixed in production and they provide no adjustment as the satellite operates.

Finally, the system 400 may also employ isolators 428A, 428B which prevent mismatched signals from reflecting back into the amplifier output ports and damaging the amplifiers.

Figure 5A:
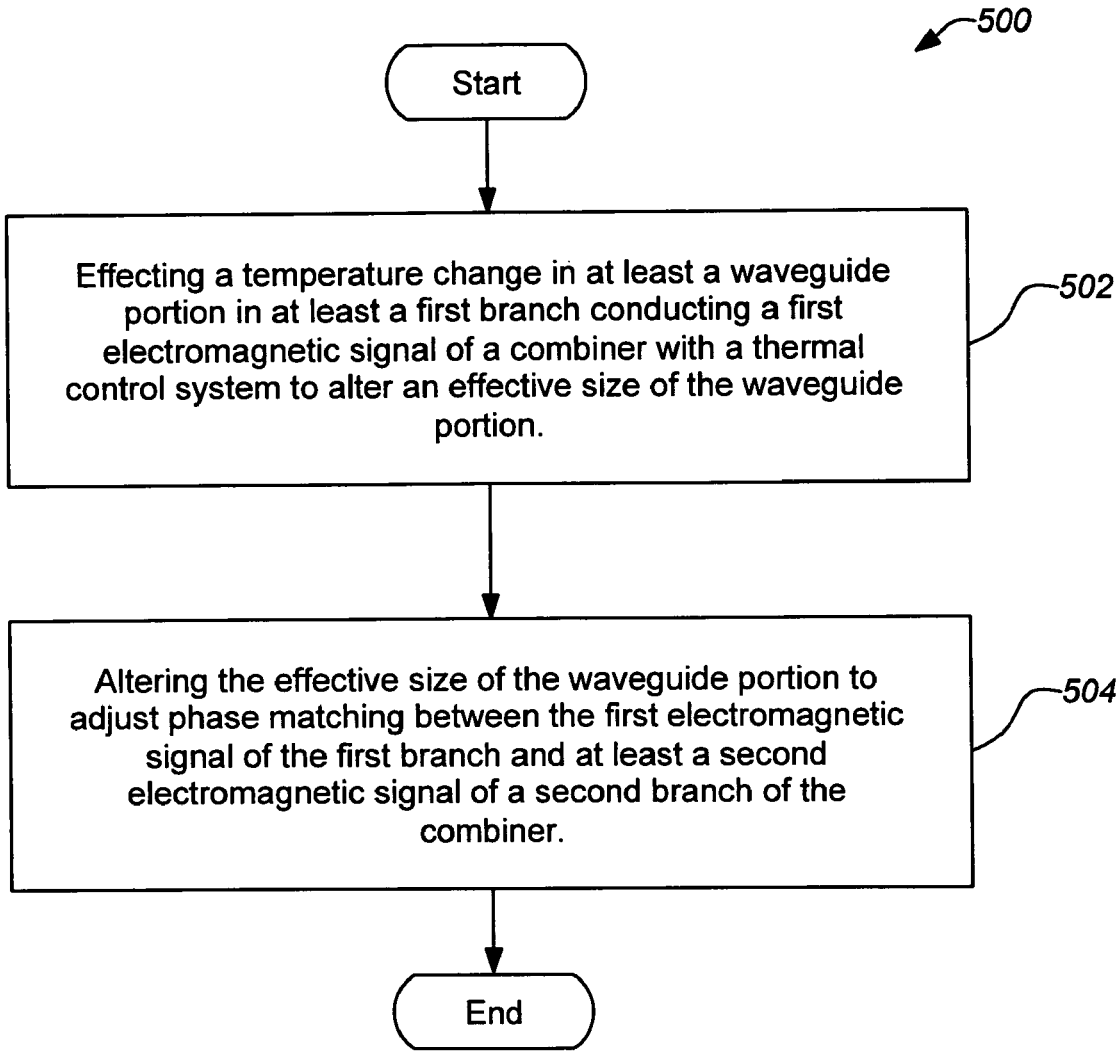
FIG. 5A is a flowchart of an exemplary method embodiment for controlling relative waveguide effective lengths through thermal modulation to produce phase matching.

FIG. 5A is a flowchart of an exemplary method 500 embodiment for controlling relative waveguide effective lengths through thermal modulation to produce phase matching. At step 502, a temperature change is effected in at least a waveguide portion in at least a first branch conducting a first electromagnetic signal of a combiner with a thermal control system to alter an effective size of the waveguide portion. And at step 504, the effective size of the waveguide portion is altered to adjust phase matching between the first electromagnetic signal of the first branch and at least a second electromagnetic signal of a second branch of the combiner. The method 500 may be further modified consistent with the apparatus embodiments described above.

Figure 5B:
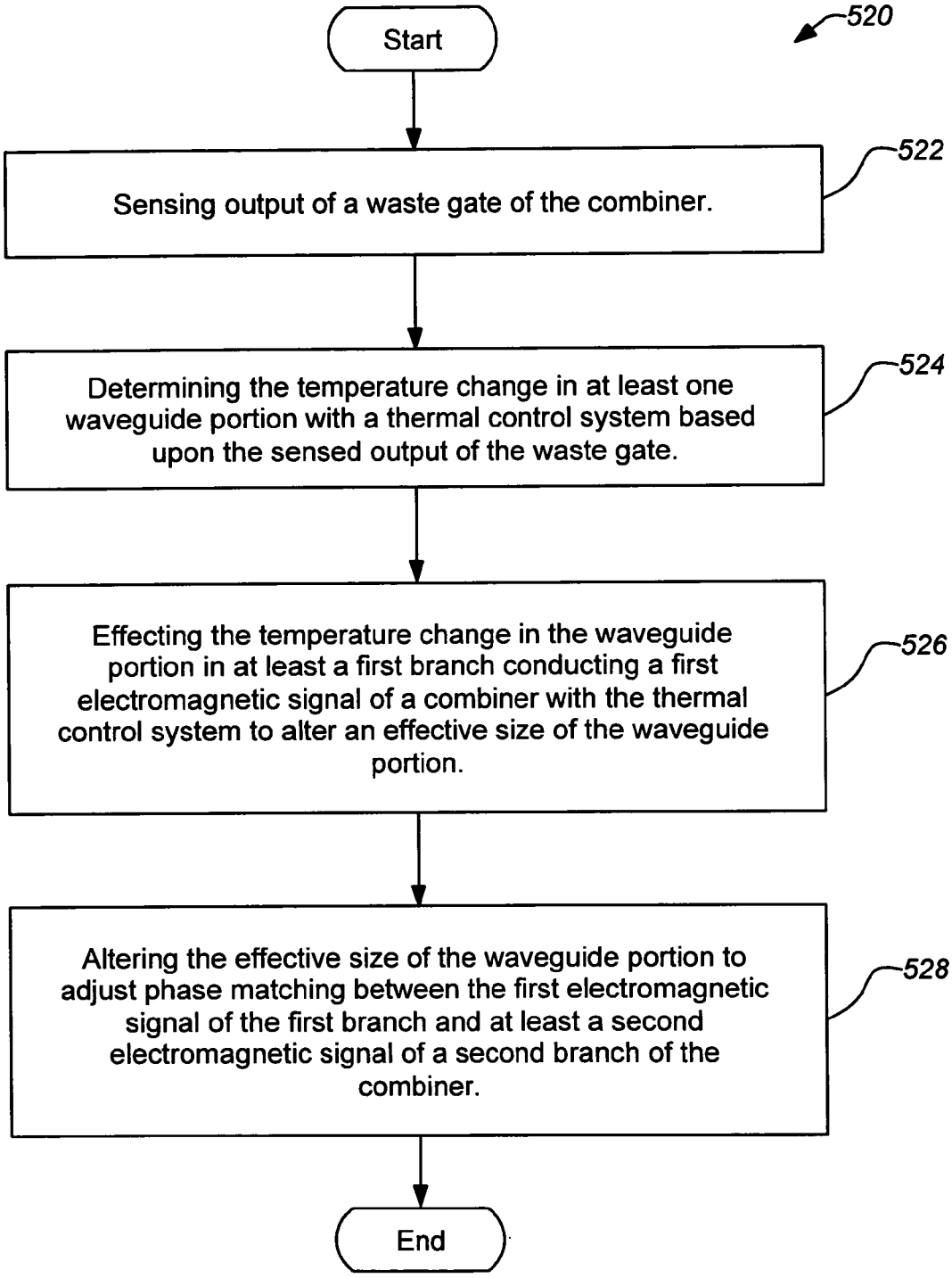
FIG. 5B is a flowchart of a further exemplary method embodiment for controlling relative waveguide effective lengths through thermal modulation to produce phase matching.

FIG. 5B is a flowchart of a further method 520 embodiment for controlling relative waveguide effective lengths through thermal modulation to produce phase matching. Essentially, this method 520 further modifies the basic method 502 of FIG. 5A above by adding waste port sensing and determining a temperature change based thereon. Beginning at step 522, output of a waste port of the combiner is sensed. Next at step 524, the temperature change in at least one waveguide portion is determined with a thermal control system based upon the sensed output of the waste port. Next, at step 526, the temperature change in the waveguide portion is effected in at least a first branch conducting a first electromagnetic signal of a combiner with the thermal control system in order to alter an effective size of the waveguide portion. Finally, at step 528 the effective size of the waveguide portion is altered to adjust phase matching between the first electromagnetic signal of the first branch and at least a second electromagnetic signal of a second branch of the combiner. The method 520 may be further modified consistent with the apparatus embodiments described above.

Figure 5C:
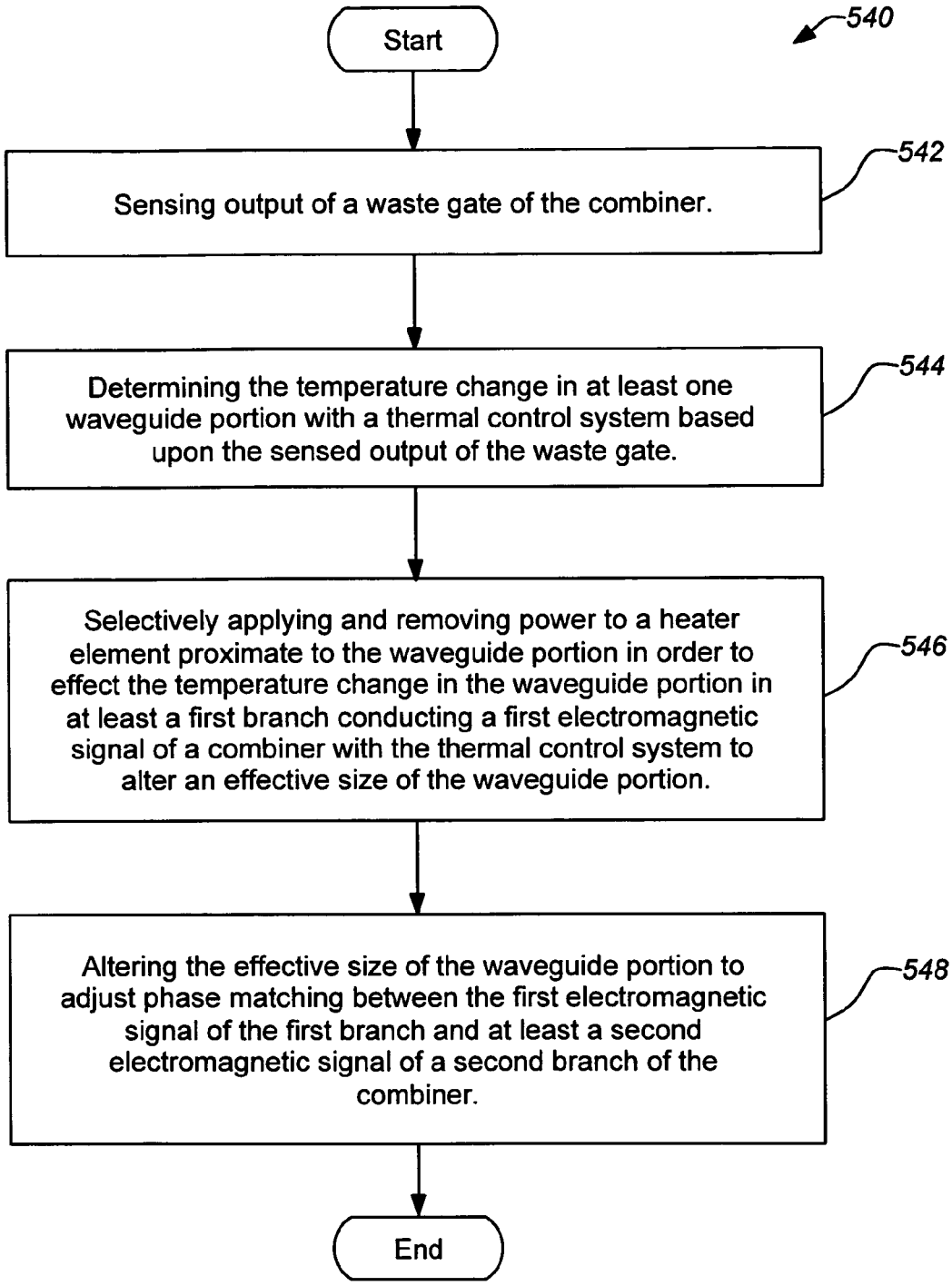
FIG. 5C is a flowchart of another exemplary method embodiment for controlling relative waveguide effective lengths through thermal modulation to produce phase matching.

FIG. 5C is a flowchart of another exemplary method 540 embodiment for controlling relative waveguide effective lengths through thermal modulation to produce phase matching. This method 540 further modifies the method 520 of FIG. 5B above by specifying that the temperature change is effected by selectively applying and removing power to a heater proximate to the waveguide portion. The method 540 begins at step 542, where output of a waste port of the combiner is sensed. Next at step 544, the temperature change in at least one waveguide portion is determined with a thermal control system based upon the sensed output of the waste port. Next, at step 546, power to a heater element proximate to the waveguide portion is selectively applied and removed in order to effect the temperature change in the waveguide portion in at least a first branch conducting a first electromagnetic signal of a combiner with the thermal control system in order to alter an effective size of the waveguide portion. Finally at step 548, the effective size of the waveguide portion is altered to adjust phase matching between the first electromagnetic signal of the first branch and at least a second electromagnetic signal of a second branch of the combiner. The method 540 may be further modified consistent with the apparatus embodiments previously described.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. An apparatus, comprising:

at least a RF waveguide portion in at least a first branch of a combiner conducting a first RF electromagnetic signal, the RF waveguide portion having an effective size; and a thermal control system effecting a temperature change in the RF waveguide portion to alter the effective size;

wherein altering the effective size of the RF waveguide portion adjusts phase matching between the first RF electromagnetic signal of the first branch and at least a second RF electromagnetic signal of a second branch of the combiner.

2. The apparatus of claim 1, wherein the thermal control system determines the temperature change in the RF waveguide portion based upon sensor output of a waste port of the combiner.

3. The apparatus of claim 1, the thermal control system comprises a heater element proximate to the RF waveguide portion and effecting the temperature change comprises selectively applying and removing power to the heater element.

4. The apparatus of claim 1, wherein the RF waveguide portion comprises a coil.

5. The apparatus of claim 1, wherein every branch of the combiner includes a thermally controlled RF waveguide portion.

6. The apparatus of claim 1, wherein at least the first branch of the combiner comprises at least two sub-branches and the RF waveguide portion is in one of the sub-branches.

7. The apparatus of claim 1, wherein the RF waveguide portion comprises a high coefficient of thermal expansion (CTE) material selected from the group consisting of polyetherimide and zinc.

8. The apparatus of claim 7, wherein the waveguide portion comprises polyetherimide and the polyetherimide is glass filled.

9. The apparatus of claim 7, wherein the high CTE material of the RF waveguide portion is silver plated.

10. The apparatus of claim 1, wherein the effective size comprises an effective length.

11. The apparatus of claim 10, wherein the RF waveguide portion comprises anisotropic thermal expansion properties having a highest coefficient of thermal expansion substantially along the effective length.

12. The apparatus of claim 11, wherein the anisotropic material comprises a composite.

13. A method, comprising the steps of:

effecting a temperature change in at least a RF waveguide portion in at least a first branch conducting a first RF electromagnetic signal of a combiner with a thermal control system to alter an effective size of the RF waveguide portion; and altering the effective size of the RF waveguide portion to adjust phase matching between the first RF electromagnetic signal of the first branch and at least a second RF electromagnetic signal of a second branch of the combiner.

14. The method of claim 13, further comprising the steps of:

sensing output of a waste port of the combiner; and determining the temperature change in the RF waveguide portion with the thermal control system based upon the sensed output of the waste port.

15. The method of claim 13, wherein effecting the temperature change comprises selectively applying and removing power to a heater element proximate to RF the waveguide portion.

16. The method of claim 13, wherein the RF waveguide portion comprises a coil.

17. The method of claim 13, wherein every branch of the combiner includes a thermally controlled RF waveguide portion.

18. The method of claim 13, wherein at least the first branch of the combiner comprises at least two sub-branches and the RF waveguide portion is in one of the sub-branches.

19. The method of claim 13, wherein the RF waveguide portion comprises a high coefficient of thermal expansion (CTE) material selected from the group consisting of polyetherimide and zinc.

20. The method of claim 19, wherein the RF waveguide portion comprises polyetherimide and the polyetherimide is glass filled.

21. The method of claim 19, wherein the high CTE material of the RF waveguide portion is silver plated.

22. The method of claim 13, wherein the effective size comprises an effective length.

23. The method of claim 22, wherein the RF waveguide portion comprises anisotropic thermal expansion properties having a highest coefficient of thermal expansion substantially along the effective length.

24. The apparatus of claim 23, wherein the anisotropic material comprises a composite.

25. An apparatus, comprising:

a RF waveguide portion means for conducting a first RF electromagnetic signal in at least a first branch of a combiner, the RF waveguide portion means having an effective size; and a thermal control means for effecting a temperature change in the RF waveguide portion means to alter the effective size;

wherein altering the effective size of the RF waveguide portion means adjusts phase matching between the first RF electromagnetic signal of the first branch and at least a second RF electromagnetic signal of a second branch of the combiner.

* * * * *